US006519787B2

(12) United States Patent
Kim

(10) Patent No.: US 6,519,787 B2
(45) Date of Patent: Feb. 18, 2003

(54) TOILET WATER RECYCLING SYSTEM

(76) Inventor: Juen S. Kim, 16709 Gramercy Pl. #B, Torrance, CA (US) 90247

( * ) Notice: Subject to any disclaimer, the term of this patent is extended or adjusted under 35 U.S.C. 154(b) by 0 days.

(21) Appl. No.: 09/773,701

(22) Filed: Feb. 1, 2001

(65) Prior Publication Data

US 2002/0100110 A1 Aug. 1, 2002

(51) Int. Cl.[7] ..... E03D 5/016

(52) U.S. Cl. ..... 4/318; 4/317; 4/319; 4/320; 4/321

(58) Field of Search ..... 4/317, 318, 319, 4/320, 321; 210/194, 195.1, 621

(56) References Cited

U.S. PATENT DOCUMENTS

| | | | | |
|---|---|---|---|---|
| 2,724,837 | A | * | 11/1955 | McPherson |
| 3,487,015 | A | * | 12/1969 | Boester |
| 3,543,294 | A | * | 11/1970 | Boester |
| 3,844,946 | A | * | 10/1974 | Farrell, Jr. |
| 3,915,857 | A | * | 10/1975 | Olson |
| 3,974,528 | A | * | 8/1976 | Claunch et al. |
| 4,040,956 | A | * | 8/1977 | Selwitz |
| 4,050,102 | A | * | 9/1977 | Kemper et al. |
| 4,197,200 | A | * | 4/1980 | Alig |
| 4,904,387 | A | * | 2/1990 | Jordan |
| 6,004,463 | A | * | 12/1999 | Swett |

FOREIGN PATENT DOCUMENTS

| | | | |
|---|---|---|---|
| EP | WO 90/09836 | * | 9/1990 |
| EP | WO 94/20347 | * | 9/1994 |
| JP | 4-64629 | * | 2/1992 |
| JP | 5-230858 | * | 9/1993 |
| JP | 09047773 A | * | 2/1997 |
| JP | WO 99/00332 | * | 1/1999 |

* cited by examiner

*Primary Examiner*—Gregory Huson
*Assistant Examiner*—Khoa D. Huynh
(74) *Attorney, Agent, or Firm*—Jerry H. Noh

(57) ABSTRACT

A water treatment and recycling system is provided having an aeration chamber, a reaction chamber, a water tank, and a plurality of pumps. The water tank houses the treated water and is the supply source for supplying water to different water needs. The first pump receives waste water from a waste source, such as a toilet, and pumps it into the aeration chamber. The aeration chamber initially treats the water and passes the contents therein via a second pump to the reaction chamber. The water is secondarily treated by the reaction chamber and thereafter pumped into the water tank. The first pump also receives a continual supply of treated water from the water tank. The aeration chamber and reaction chamber contains therein a plurality of specially treated wood chips, and a bio-colony consisting of different microbes and bacteria introduced into the wood chips.

10 Claims, 4 Drawing Sheets

TOILET WATER RECYCLING SYSTEM

BACKGROUND OF THE INVENTION

I. Field of The Invention

The present invention relates to a water recycling system. More particularly, the present invention relates to a water treatment and recycling system capable of receiving waste water from and providing treated water to one or more toilets.

II. Description of the Prior Art

Water treatment systems for treating and recycling waste water from toilets are known in the prior art. Some systems use filters and/or a combination of chemicals and filters to treat waste water. Other systems use biological treatment consisting of bacteria and microbes. Some systems involve the use of a single anaerobic biological treatment chamber for waste water while others involve the use of separate anaerobic and aerobic treatment chambers.

Other conventional methods include a precipitation/separation process followed by a filtration cycle for waste water containing feces. The influx of the feces then remains in its place where separation of the solids and liquids occur. Solids are then collected every year to be discarded and remaining liquids that are in its anaerobic state are discharged. The disadvantage of this method is that it has a low rate of water treatment capability, and further it can pose a threat to the ground water when it is discharged into the environment. As a result, liquids and solids collected from this process have to be discarded with extreme caution as not to pollute our environment.

SUMMARY OF THE INVENTION

The present invention provides a recycling system that completely breaks down human and/or animal waste water and any biodegradable solid or liquid byproducts into water and carbon dioxide, and thus creates a pure form of water to be recycled and utilized again.

The present invention also provides a water treatment and recycling system which can be effectively utilized with a toilet system. The present invention further provides a method of waste water treatment.

The water treatment and recycling system according to an embodiment of the present invention includes an aeration chamber, a reaction chamber, a water tank, and a plurality of pumps. The aeration chamber and reaction chamber contain therein a plurality of specially treated red-cedar wood chips, and a bio-colony consisting of 16 different microbes and bacteria introduced into the red-cedar wood chips. The first pump receives waste water from a waste source and pumps it into the aeration chamber. The aeration chamber initially treats the water and passes the contents therein via a second pump to the reaction chamber. The water is treated by the reaction chamber and passed via a third pump into the decoloration chamber and then into the water tank. The water tank houses the treated water and is the supply source for supplying water to different water needs. When used with a toilet system, the water tank supplies water to the water holding tanks of the toilets. The bacteria introduced into the wood chips consists of a predetermined balance of aerobes, anaerobes, and facultative (both aerobic and anaerobic) bacteria.

BRIEF DESCRIPTION OF THE DRAWING

With the above and additional objects and advantages in view, as will hereinafter appear, this invention comprises the devices, combinations and arrangements of parts hereinafter described, by way of example, and illustrated in the accompanying drawings of a preferred embodiment in which.

DESCRIPTION OF THE PREFERRED EMBODIMENT

Figure 1:
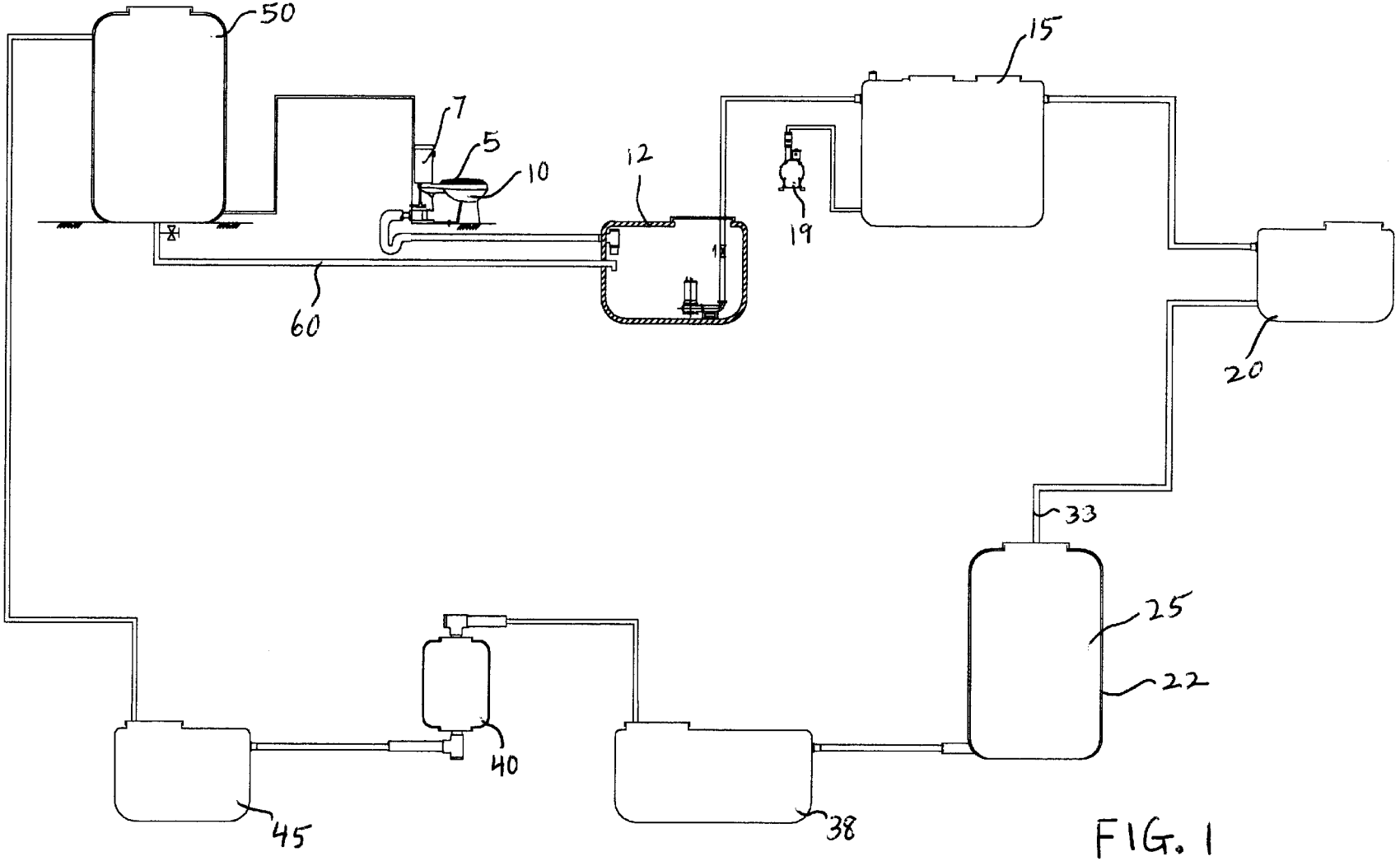
FIG. 1 is an overall view of the toilet recycling system according to an embodiment of the present invention.

FIG. 1 shows the waste water treatment and recycling system according to an embodiment of the present invention. In this embodiment, the system is shown to be used in conjunction with a single conventional toilet. The recycling system is capable of being adapted for use with most all types conventional toilets including the stand-up urinal toilets. Furthermore, the recycling system is capable of being adapted for use with multiple toilets. In fact, the toilet itself does not constitute a part of the invention. The invention is directed to a recycling system for waste water that is to be used in toilets.

The toilet water recycling system shown in FIG. 1 comprises a toilet 5 having a flush water tank 7 and a urinal 10. Once the flush button hands (not shown) of the toilet 5 have been activated, an AUX Pump (not shown) working at a pressure of 35 Psi transfers any solid and liquid waste from the urinal to the waste water treatment system. The waste water treatment system comprises a first pumping station 12, an aeration chamber 15, and a reaction chamber 22.

The first pumping system 12 initially receives waste water including any solid waste from the toilet 5, and a strainer (not shown) contained therein filters non-bio-degradable misplaced items such as pens, rings and other tangible items. After the initial strainer, there is a mechanical grind device (not shown) placed within the first pumping system for grinding of any solid waste into smaller pieces. Typically these ground-up solids are about 50 mg/Liter.

Figure 2:
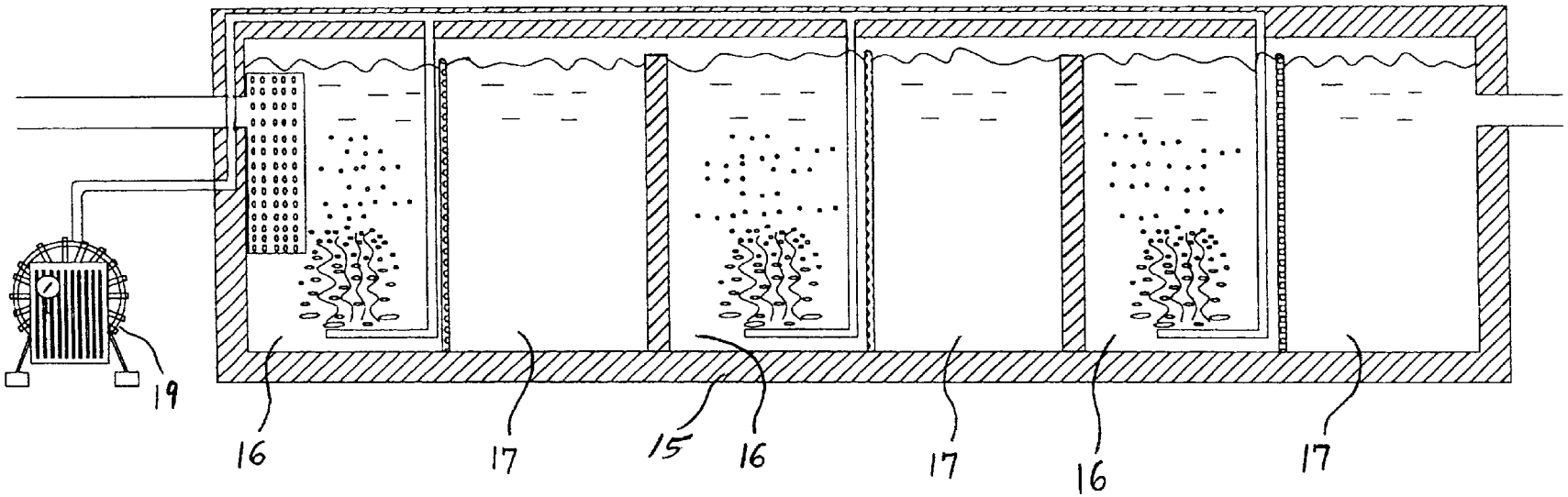
FIG. 2 is an isolated view of the aeration chamber according to an embodiment of the present invention; and, FIG. 3 is an isolated view of the reaction chamber according to an embodiment of the present invention.

When a predetermined volume of water is accumulated within the first pumping system 12, the waste water is then pumped into the aeration chamber 15, which is preferably made out of 304 Stainless Steel. The aeration chamber 15 is separated into a series of compartments interchanging between an aerobic compartment 16 and a non-aerobic compartment 17 as shown in FIG. 2. An air pump 19 is attached to the aeration chamber 15 for providing air into the chamber 15. The air pump 19 provides air only into the aerobic compartments 16. Furthermore, the aeration chamber 15 contains a porous container 21, and the container 21 is positioned so that waste water entering the aeration chamber 15 from the first pumping system will first pass through the container 21. The aeration chamber 15 contains specially treated red cedar wood chips 23 which is provided with a combination of sixteen different microbes and bacteria. The wood chips 23 can be placed both in the container and throughout the different compartments. The wood chips 23 are preferably made of red cedar wood because of its ideal porous quality which provides an ideal habitat for microbes and bacteria. The microbes and bacteria in the aeration chamber 15 substantially contribute in breaking the suspended solids further into smaller pieces at its cellular level. Waste breakdown occurs ideally when the air pump 19 consistently blows 0.8–2.2 liters per minute of air into the aerobic compartments of the aeration chamber 15. In the preferred embodiment, 1.8 liters per minute of air is blown into the aeration chamber 15 for maximal waste breakdown. The aeration chamber 15 is connected by a second pump 20 to the reaction chamber 22.

Treated water from the aeration system 15 is next pumped into the second pump 20 and into the reaction chamber 22. The reaction chamber comprises a container 25 having layers of the treated wood chips 23 that contain a combination of sixteen different microbes and bacteria disposed therein. The container 25 has a plurality of porous holes disposed throughout the its side surface. The holes are of a predetermined size small enough in diameter to keep the wood chips 23 therein, and the holes are of a predetermined size large enough to maintain roughly a 90% aerobic and 10% anaerobic condition within the container 25. The container 25 can be cylindrical in shape with an open top surface. A collection receptacle 24 is placed beneath the container 25 to gather treated water passing through the container 25 and funnel the water to a third pump 38.

Figure 3:
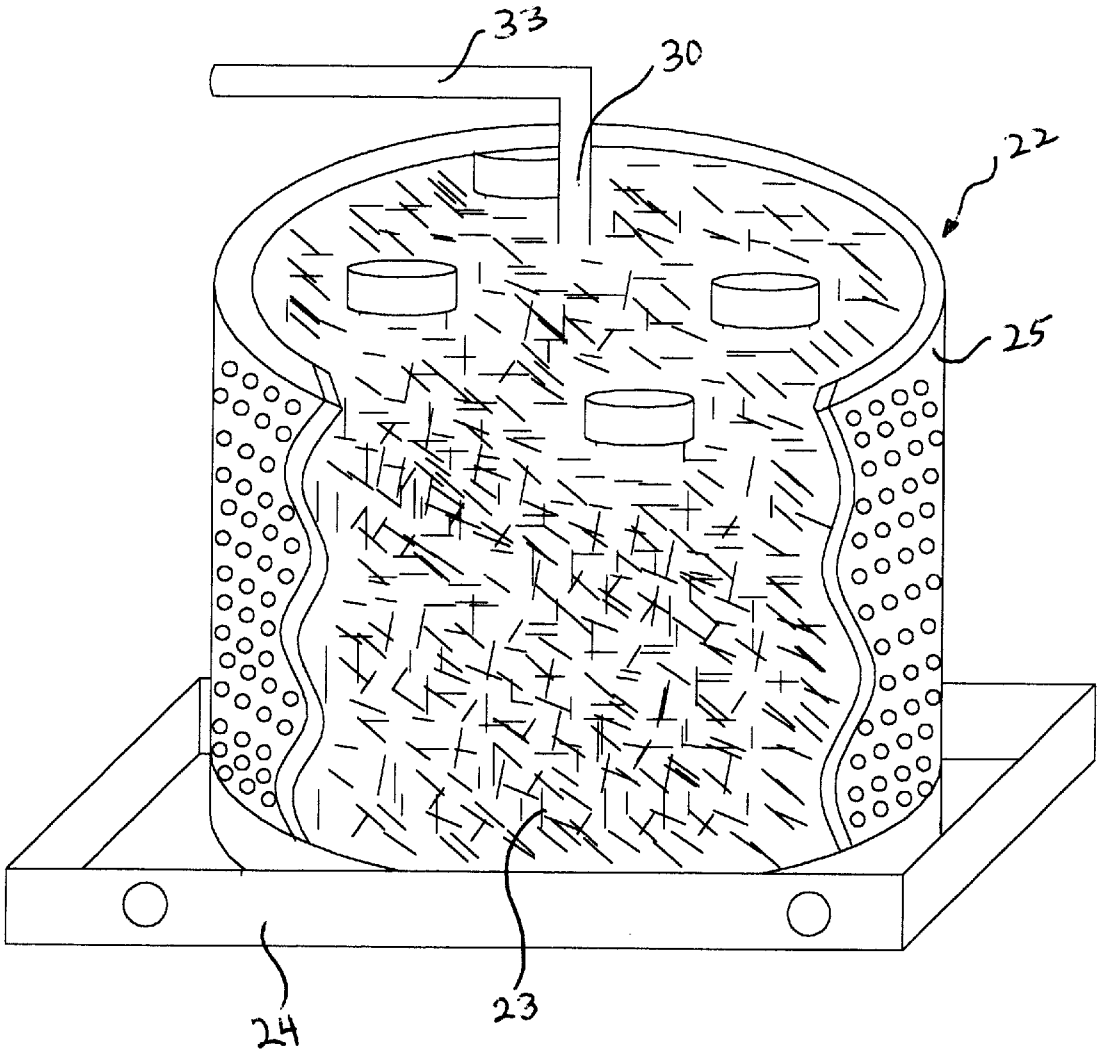
FIG. 3A is an isolated view of the distributor according to an embodiment.
Figure 3A:
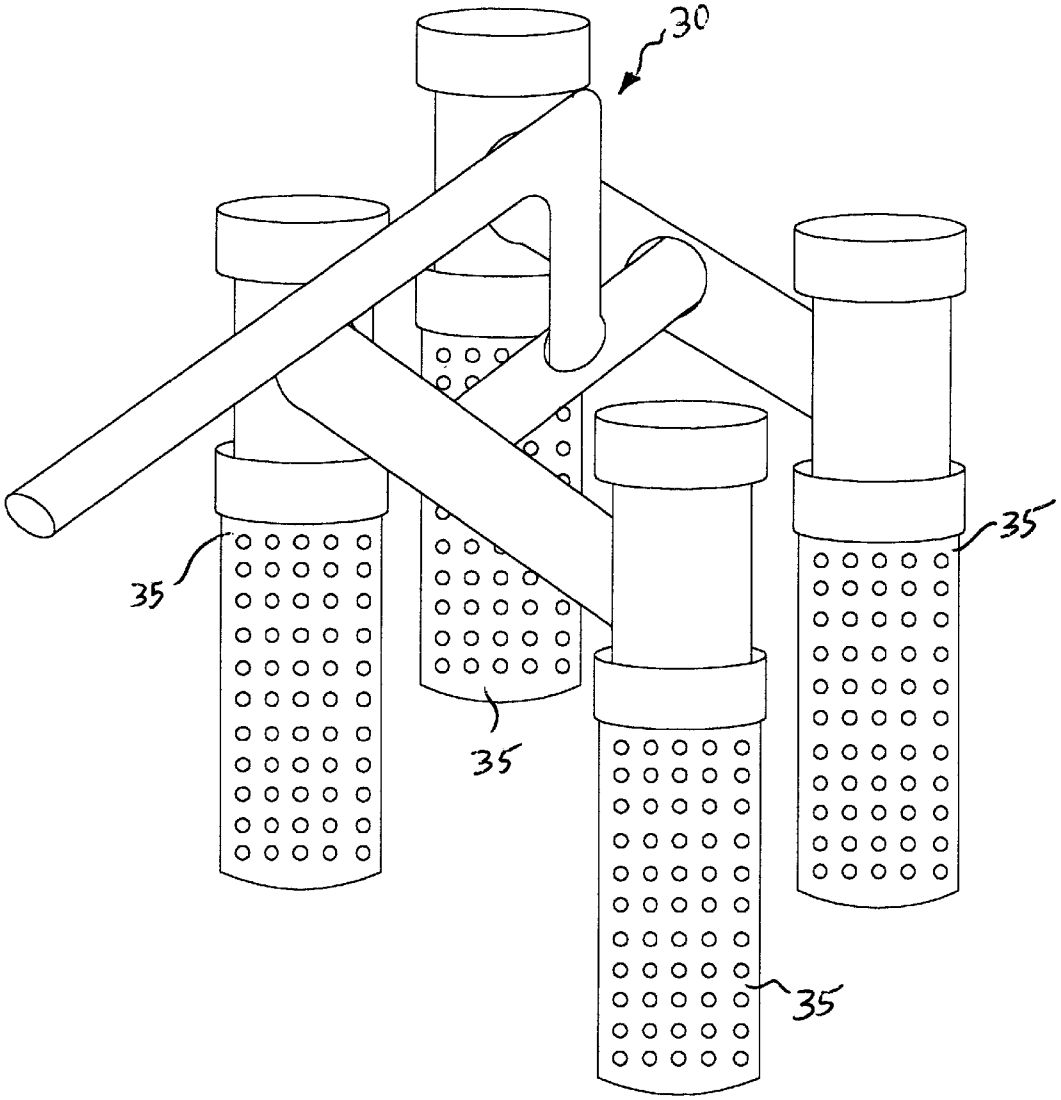

The reaction chamber 22 further includes a distributor 30. As shown in FIG. 3, a tubing 33 leading from the second pump 20 to the reaction chamber 22 attaches to the distributor 30 having one or more hollow arms 35 which are inserted into the container 25. The arms 35 becomes immersed within the wood chips 23. The hollow arms 35 have a plurality of holes defined throughout its surface through which water is discharged in a streamlined manner into the container 25.

The aeration chamber 15 is an aerobically airtight unit resulting in the ability of anaerobic microorganisms to flourish. However, in the reaction chamber 22, the waste products are well-exposed to oxygen to promote an environment suitable for the growth of aerobic microorganisms. Because of the ability to generate and maintain a healthy population bacteria and microbes, the amount of waste present in the treatment system is able to be completely broken down.

The resulting water treated by the reaction chamber 22 is collected into a third pump 38 and pumped into a decoloration chamber 40. Within the decoloration chamber 40, water decoloration and deodorizing agents known in the prior art such as carbon filters (not shown) are utilized.

A fourth pump 45 connects the decoloration chamber 40 to a water tank 50. The water tank 50 stores the final treated water and has a pump connected thereto for pumping supplies of recycled water to the flush water tank 7 of the toilet 5.

For eliminating the build up of stench and to promote a healthy bio-colony, a second tubing 60 connects the water tank 50 to the first pumping station 12. Through this tubing 60, a constant supply of water from the water tank 50 is supplied at a predetermined rate to the first pumping station 12. When the storage tank 50 holds water, the natural pressure of the water results in the discharging movement of water from the water tank 50 via the second tubing 60 into the first pumping station 12. A valve is utilized to regulate the rate of water discharged into the first pumping station 12. A sensor (not shown) is placed within the first pumping station 12 for discharging waste water therein into the aeration chamber 15 when a predetermined volume of waste water, treated or untreated, has accumulated therein. Thus, even when the toilet 5 is not in use for a prolonged period of time, the recycling system will still circulate water through the entire system to prevent the stagnation of the water supply.

The specially treated wood chips 23 utilized in the aeration chamber 15 and the reaction chamber 22 are prepared in the following manner. The wood chips 23 are preferably made of wood from the xylem layer of red cedar trees because it has a highly porous property. The porous property makes these wood chips from the xylem layer of red cedar trees an ideal habitat for promoting healthy generation and maintenance of bacteria colonies. These wood chips from the trees are cut into sizes ranging from 3–5 mm in length and width. When the bottom of a red cedar tree is cut, the tracheid cells still retain water. In order to be used in the present invention, the tracheid cells are artificially opened, and the water within these cells are removed.

During this is process it is extremely important to make sure the tracheid cells are not twisted since any twisting would block flowage of water therethrough. To achieve this, the following manufacturing steps must be followed. The freshly cut wood chips are first submerged in a solution of acetylene-acid-lithium or silicic-acid-lithium for approximately twenty four hours and thereafter rinsed in distilled water. The chips are then dried in a dehydrator to remove the water molecules from the tracheids. The tracheids and the surface area of the wood chips provides an ideal housing habitat for promoting healthy maintenance of a concentrated colony of microbes and bacteria. The red-cedar chips also serve as a rich cellulose source for the bio-colony of microbes and bacteria.

Once the wood chips are treated and placed into the respective chambers, a bio-colony of sixteen different microbes and bacteria are introduced into the wood chips. The microbes and bacteria flourish within and on the wood chips. A highly concentrated colony, allows for a compact reaction chamber and aeration chamber.

In the preferred embodiment, the reaction chamber is filled with wood-chips. For maximal effectiveness of bio-colony generation, one or more layers of wood chips made from oak tree are placed between the layers of wood chips made from red cedar tree.

Although a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claims which follow.

What is claimed is:

1. A water recycling system for treating waste water from a waste water source and recycling the treated waste water to the waste water source, said recycling system comprising:

a first pump unit for initially receiving waste water from said waste water source;

an aeration chamber connected to said first pump unit for initial biological treatment of waste water, said aeration chamber further comprising two or more aerobic compartments and two or more non-aerobic compartments, whereby said aerobic and non-aerobic compartments are positioned in series interchangeably between aerobic and non-aerobic compartments;

at least one air pump connected to said aeration chamber for providing air only into said aerobic compartments;

a reaction chamber connected to receive treated waste water from said aeration chamber and providing secondary biological treatment of waste water;

a second pump for transferring waste water from said aeration chamber to said reaction chamber;

a water tank connected to receive the treated water from said treatment system;

a third pump for transferring treated waste water from said reaction chamber to said water tank;

a first connection member connecting said water tank to said waste water source to supply the treated water from the water tank to the waste water source; and, a second connection member connecting said water tank to said first pump unit to supply the treated water from the water tank to said first pump.

2. A water recycling system as described in claim 1 wherein said second connection member provides water from said water tank to said first pump unit at a constant predetermined rate.

3. A water recycling system as described in claim 1 further comprising wood chips from red cedar tree disposed within said aerobic chamber and said reaction chamber.

4. A water recycling system as described in claim 1 wherein said aerobic chamber and reaction chamber are provided with bacteria and microbes for the biological treatment of the waste water.

5. A water recycling system as described in claim 1 wherein 0.8 to 2.2 liters per minute of air is consistently blown into said aeration chamber.

6. The water recycling system as described in claim 1 wherein the aeration chamber further comprises a porous container disposed therein, said porous container being positioned so that waste water entering the aeration chamber will first pass through said container.

7. In a flush-type toilet comprising a demand actuator, a bowl in which sanitary waste is deposited, a flush water supply tank for supplying flush water upon activation of said demand actuator, a recycling system for treatment of the waste water discharged from said toilet and recycling the treated waste water as clean flush water to said supply tank, said recycling system comprising:

a first pump unit;

an aeration chamber connected to said first pump unit for initial biological treatment of waste water, said aeration chamber further comprising two or more aerobic compartments and two or more non-aerobic compartments, whereby said aerobic and non-aerobic compartments are positioned in series interchangeably between aerobic and non-aerobic compartments;

at least one air pump connected to said aeration chamber for providing air only into said aerobic compartments;

a reaction chamber connected to receive treated waste water from said aeration chamber and providing secondary biological treatment of waste water;

a second pump for transferring waste water from said aeration chamber to said reaction chamber;

a third pump for transferring treated waste water from said reaction chamber to said water tank;

a water tank connected to receive and store treated water from said recycling system;

said first pump unit initially receiving waste water from said bowl upon activation of the demand actuator;

first connection member for providing water from said water tank to said flush water supply tank; and a second connection member for providing treated water from said water tank to said first pump unit.

8. A flush-type toilet as described in claim 7 further comprising wood chips from red cedar tree disposed within said aeration and reaction chambers.

9. A flush-type toilet as described in claim 7 wherein said aeration and reaction chambers are provided with bacteria and microbes for the biological treatment of the waste water.

10. A flush-type toilet as described in claim 7 wherein 0.8 to 2.2 liters per minute of air is consistently blown into said aeration chamber.

* * * * *